US011060442B2

(12) United States Patent
Jeong et al.

(10) Patent No.: US 11,060,442 B2
(45) Date of Patent: Jul. 13, 2021

(54) ENGINE COOLANT COOLING SYSTEM FOR VEHICLE

(71) Applicants: Hyundai Motor Company, Seoul (KR); Kia Motors Corporation, Seoul (KR)

(72) Inventors: Jae Eun Jeong, Hwaseong-Si (KR); Nam Ho Park, Suwon-Si (KR); Seong Bin Jeong, Hwaseong-Si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 16/700,026

(22) Filed: Dec. 2, 2019

(65) Prior Publication Data

US 2020/0386144 A1 Dec. 10, 2020

(30) Foreign Application Priority Data

Jun. 10, 2019 (KR) ..... 10-2019-0067832

(51) Int. Cl.
*F01P 7/16* (2006.01)
*F28D 1/053* (2006.01)
*F01P 7/14* (2006.01)

(52) U.S. Cl.
CPC ..... *F01P 7/164* (2013.01); *F01P 2007/146* (2013.01); *F01P 2007/168* (2013.01); *F28D 1/05341* (2013.01)

(58) Field of Classification Search
CPC ..... F01P 7/164; F01P 2007/146; F01P 2007/168; F28D 1/05341
See application file for complete search history.

(56) References Cited

U.S. PATENT DOCUMENTS

2012/0247440 A1* 10/2012 Sano ..... F02M 26/70 123/568.17
2016/0290216 A1* 10/2016 Katragadda ..... F01P 11/16

OTHER PUBLICATIONS

Sure Seal High Performance Butterfly Valves, 2013, OPW Fluid Transfer Group, ANSI Classes 150 & 300, pp. 1-3 (Year: 2013).*

* cited by examiner

*Primary Examiner* — Jacob M Amick
*Assistant Examiner* — Charles J Brauch
(74) *Attorney, Agent, or Firm* — Morgan, Lewis & Bockius LLP

(57) ABSTRACT

The present invention relates to an engine coolant cooling system for a vehicle, and provides an engine coolant cooling system for a vehicle, which can increase the heat-dissipation performance of a radiator if necessary without increasing the size of the radiator, securing the cooling performance of the coolant.

14 Claims, 9 Drawing Sheets

ENGINE COOLANT COOLING SYSTEM FOR VEHICLE

CROSS-REFERENCE TO RELATED APPLICATION

The present application claims priority to Korean Patent Application No. 10-2019-0067832 filed on Jun. 10, 2019, the entire contents of which is incorporated herein for all purposes by this reference.

BACKGROUND OF THE INVENTION

Field of the Invention

The present invention relates to an engine coolant cooling system for a vehicle, and more particularly, to an engine coolant cooling system for a vehicle, which can improve the coolant heat-dissipation performance of a radiator.

Description of Related Art

In recent years, a catalytic converter is mounted in an engine exhaust system for a vehicle to purify exhaust gas. The catalytic converter reduces the pollutants contained in the exhaust gas by use of catalyst.

To improve the purification performance of the catalytic converter, the catalyst temperature may be optimized. To optimize the catalyst temperature, the engine coolant is used to lower the temperature of the exhaust gas to an appropriate temperature. The engine coolant absorbs the heat generated in an engine 2 while passing through the inside of the engine 2 and dissipates heat to the atmosphere while passing through a radiator 3 (see FIG. 11). The radiator is a heat exchanger for absorbing heat from the engine to cool the heated engine coolant.

However, when the temperature of the engine coolant increases excessively due to the high heat of the exhaust gas, there occurs a problem in that the cooling performance of the engine coolant is reduced and the engine is overheated.

To improve the above problem, when the size of the radiator is increased, it is possible to cool the engine coolant smoothly, preventing the cooling performance of the engine coolant from being reduced. However, when the size of the radiator is increased, there occurs a problem in that the motor capacity of a blower for radiator may be increased, and therefore, the layout of an engine compartment where the radiator and the blower are mounted becomes complicated. Furthermore, when the size of the radiator is increased, the effect of improving the performance of the radiator is inferior to an increase in cost and weight due to the increase in size.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing an engine coolant cooling system for a vehicle, which can increase the heat-dissipation performance of a radiator if necessary without increasing the size of the radiator, securing the cooling performance of the coolant.

Therefore, various aspects of the present invention provide an engine coolant cooling system for a vehicle including a radiator including an inlet tank provided with an inlet nipple for inflow of coolant, an outlet tank provided with an outlet nipple for discharging the coolant, and a radiator core including a plurality of coolant passages connected between the inlet tank and the outlet tank to heat-dissipate the coolant; an inlet valve unit mounted in an internal flow path of the inlet tank to selectively divide the internal flow path of the inlet tank into a first inlet flow path communicating with the inlet nipple and a second inlet flow path separated from the inlet nipple; an outlet valve unit mounted in an internal flow path of the outlet tank to selectively divide the internal flow path of the outlet tank into a first outlet flow path communicating with the outlet nipple and a second outlet flow path not communicating with the outlet nipple; and a controller for controlling operations of the inlet valve unit and the outlet valve unit according to a temperature of the coolant, and predetermined passage among the coolant passages connected to the second outlet flow path is connected to the first inlet flow path, and the coolant passage not connected to the first inlet flow path among the coolant passages connected to the second outlet flow path is connected to the second inlet flow path. The engine coolant cooling system for the vehicle has the following characteristics.

The coolant passage not connected to the second outlet flow path among the coolant passages connected to the second inlet flow path is connected to the first outlet flow path. Accordingly, the plurality of coolant passages is mounted and connected in a line between the inlet tank and the outlet tank. An engine water pump and an electronic water pump for circulating the coolant are mounted between the radiator and an engine, and the electronic water pump is driven according to the temperature of the coolant to increase a flow rate of the coolant circulated in the engine and the radiator by the engine water pump.

The controller can operate the inlet valve unit to divide the internal flow path of the inlet tank into the first inlet flow path and the second inlet flow path, and operate the outlet valve unit to divide the internal flow path of the outlet tank into the first outlet flow path and the second outlet flow path, when the temperature of the coolant is equal to or higher than a first reference temperature.

Furthermore, the controller is configured to drive the engine water pump and the electronic water pump, when the temperature of the coolant becomes equal to or higher than a second reference temperature, which has been set higher than the first reference temperature. The controller is configured to not operate the inlet value unit and the outlet valve unit when the temperature of the coolant is equal to or higher than the second reference temperature.

Furthermore, the controller operates the inlet valve unit and the outlet valve unit while driving the engine water pump and the electronic water pump, when the temperature of the coolant is equal to or higher than a third reference temperature, which has been set higher than the second reference temperature.

The controller operates only the engine water pump and does not operate the electronic water pump, the inlet valve unit, and the outlet valve unit, when the temperature of the coolant is lower than the first reference temperature.

Meanwhile, an inlet membrane provided with an inlet flow hole is mounted between the first inlet flow path and the second inlet flow path, and the inlet flow hole is open or closed by the inlet valve unit. Furthermore, an outlet membrane provided with an outlet flow hole is mounted between the first outlet flow path and the second outlet flow path, and the outlet flow hole is open or closed by the outlet valve unit.

The inlet valve unit may be configured to include an inlet valve rotatable in the inlet flow hole to open or close the inlet flow hole; and an inlet motor coupled to the inlet valve and controlled by the controller to rotate the inlet valve at a certain angle at which the inlet flow hole is open and closed. An inlet O-ring is mounted on an external circumferential surface of the inlet valve, and the inlet O-ring seals the inlet flow hole when the inlet flow hole is closed by the inlet valve. Furthermore, the inlet valve is provided with an inlet stopper rotated integrally with the inlet valve, and the inlet stopper stops rotation of the inlet valve while being locked by the surface of the inlet membrane when the inlet valve closes the inlet flow hole.

The outlet valve unit may be configured to include an outlet valve rotatable in the outlet flow hole to open or close the outlet flow hole; and an outlet motor coupled to the outlet valve and controlled by the controller to rotate the outlet valve at a certain angle at which the outlet flow hole is open and closed. An outlet O-ring is mounted on an external circumferential surface of the outlet valve, and the outlet O-ring seals the outlet flow hole when the outlet flow hole is closed by the outlet valve. Furthermore, the outlet valve is provided with an outlet stopper rotated integrally with the outlet valve, and the outlet stopper stops rotation of the outlet valve while being locked by the surface of the outlet membrane when the outlet valve closes the outlet flow hole.

According to the engine coolant cooling system for the vehicle according to an exemplary embodiment of the present invention, it is possible to change the flow path of the coolant flowing into the radiator without increasing the size of the radiator, increasing the heat-dissipation amount of the coolant, and furthermore, to increase the flow rate of the coolant using the electronic water pump 7, further increasing the heat-dissipation amount of the coolant.

It is understood that the term "vehicle" or "vehicular" or other similar term as used herein is inclusive of motor vehicles in general such as passenger vehicles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The above and other features of the present invention are discussed infra.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
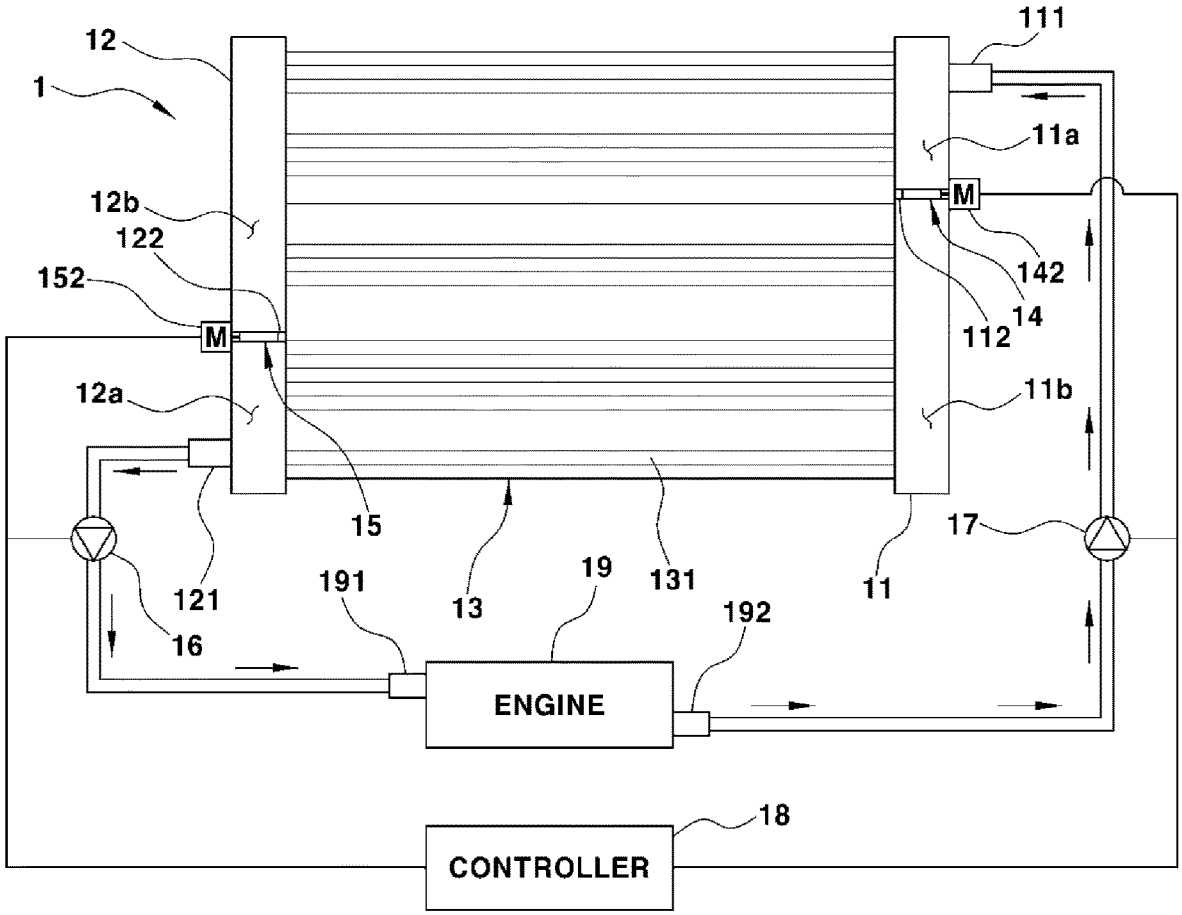
FIG. 1 is a diagram showing a configuration of an engine coolant cooling system for a vehicle according to an exemplary embodiment of the present invention.

It may be understood that the appended drawings are not necessarily to scale, presenting a somewhat simplified representation of various exemplary features illustrative of the basic principles of the present invention. The specific design features of the present invention as included herein, including, for example, specific dimensions, orientations, locations, and shapes will be determined in section by the particular intended application and use environment.

In the drawings, reference numbers refer to the same or equivalent sections of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, the present invention will be described so that those skilled in the art can easily practice the present invention.

As shown in FIG. 1, a radiator 1 through which the coolant for cooling an engine 19 flows may be configured to include an inlet tank 11, an outlet tank 12, and a radiator core 13 mounted between the inlet tank 11 and the outlet tank 12.

The inlet tank 11 is provided with an inlet nipple 111 into which the coolant flows, and the coolant flowing into the inlet tank 11 through the inlet nipple 111 flows through a radiator core 3 through the internal flow path (i.e., internal space) of the inlet tank 11. The inlet tank 11 may be mounted to be connected to one side end portion of the radiator core 13.

The radiator core 13 includes a plurality of coolant passages 131 connected between the inlet tank 11 and the outlet tank 12, and the coolant flowing through the coolant passages 131 may be cooled through the heat exchange with the atmosphere. That is, the radiator core 13 can dissipate the heat of the coolant flowing through the coolant passage 131 through the heat exchange with the outside air. The plurality of coolant passages 131 may be mounted in a line between the inlet tank 11 and the outlet tank 12, and each of the coolant passages 131 may be formed in a straight-line shape between the inlet tank 11 and the outlet tank 12. Each coolant passage 131 has the inlet tank 11 connected to one side end portion thereof, and has the outlet tank 12 connected to the other side end portion thereof. The coolant may be distributed from the inlet tank 11 to flow into the plurality of coolant passages 131 (see FIG. 2).

The outlet tank 12 is provided with an outlet nipple 121 through which the coolant is discharged, and the coolant discharged from the outlet tank 12 through the outlet nipple 121 can flow into the engine 19. The outlet tank 12 may be mounted to be connected to the other side end portion of the radiator core 13. The outlet tank 12 may be connected to the plurality of coolant passages 131 so that the coolant discharged from the coolant passage 131 can flow therein (see FIG. 2). The coolant discharged from the coolant passage 131 may be collected in the internal flow path of the outlet tank 12, and the collected coolant may be discharged to the outside of the outlet tank 12 through the outlet nipple 121.

An inlet valve unit 14 and an outlet valve unit 15 may be mounted in the inlet tank 11 and the outlet tank 12, respectively.

Figure 2:
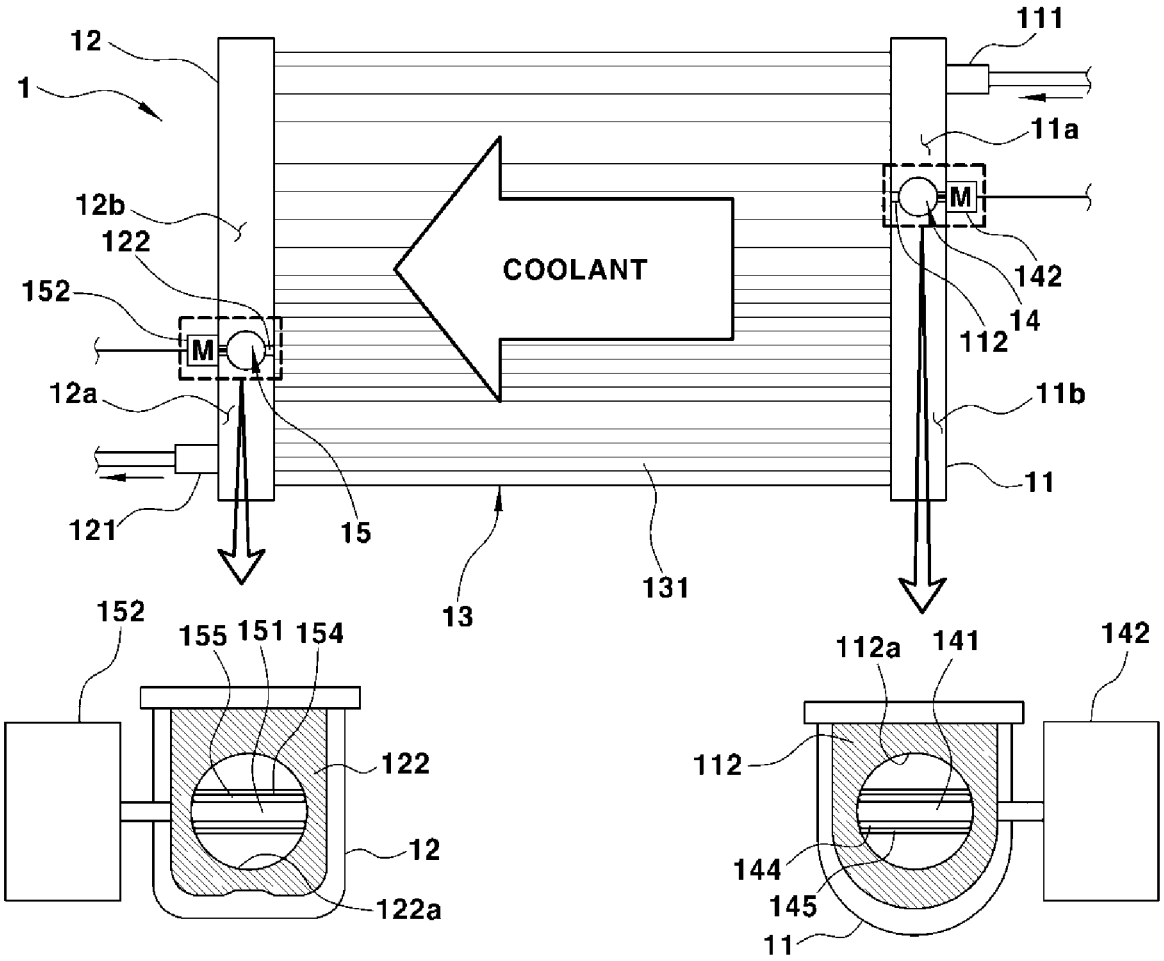
FIG. 2 is a diagram showing the coolant flow path of a radiator when a valve unit according to an exemplary embodiment of the present invention is in an open state.
Figure 3:
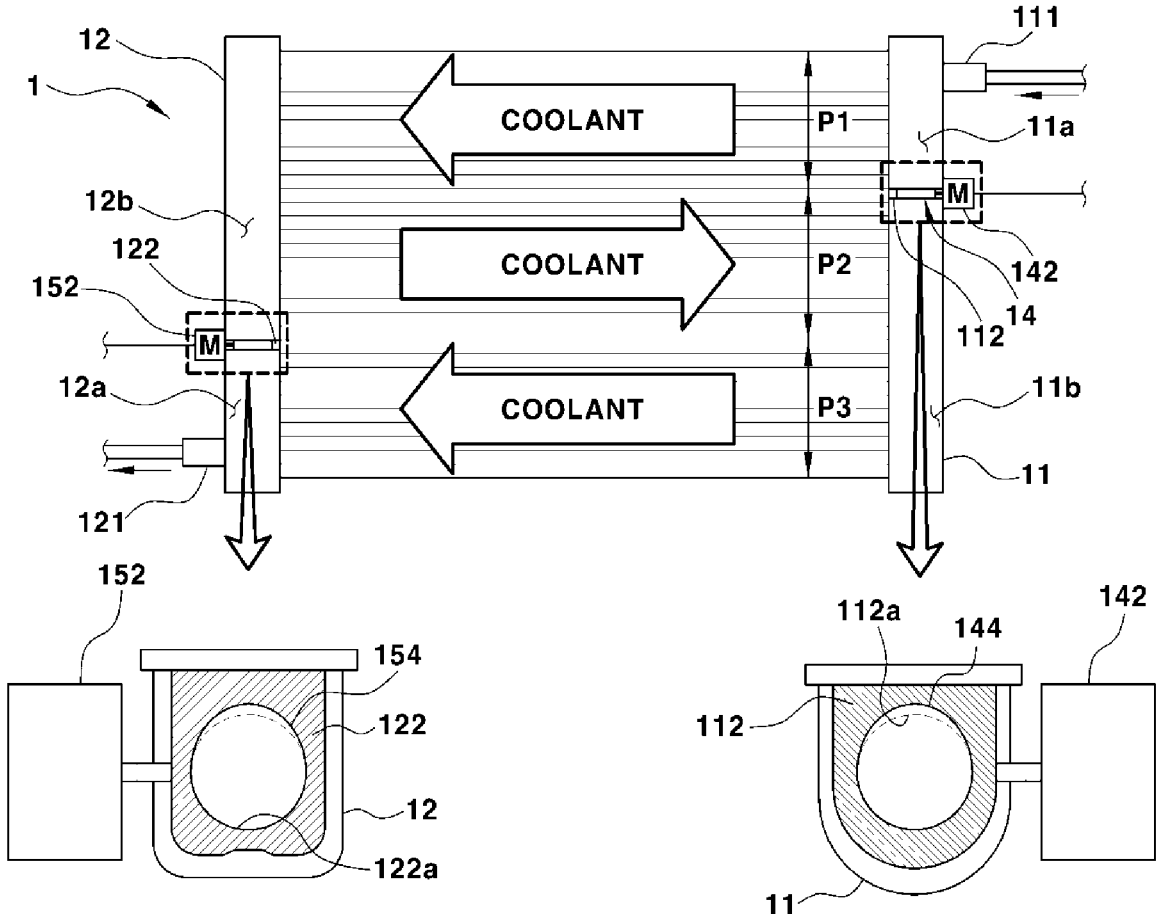
FIG. 3 is a diagram showing the coolant flow path of the radiator when a valve unit according to an exemplary embodiment of the present invention is in a closed state.

As shown in FIG. 2 and FIG. 3, the inlet valve unit 14 may be mounted in the internal flow path of the inlet tank 11 to air-tightly separate the internal flow path. The inlet valve unit 14 may be mounted at a branch point of the internal flow path to selectively divide the internal flow path. The internal flow path may be divided into a first inlet flow path 11*a* and a second inlet flow path 11*b* with respect to the inlet valve unit 14. The first inlet flow path 11*a* is a portion where the inlet nipple 111 is mounted in the internal flow path that has been divided with respect to the inlet valve unit 14, and may be directly communicating with the inlet nipple 111. The second inlet flow path 11*b* is a portion where the inlet nipple 111 is not mounted in the internal flow path that has been divided with respect to the inlet valve unit 14, and cannot be directly communicating with the inlet nipple 111. The second inlet flow path 11*b* may be indirectly communicating with the inlet nipple 111 through a second outlet flow path 12*b*. When the first inlet flow path 11*a* and the second inlet flow path 11*b* are separated by the inlet valve unit 14 mounted therebetween, the direct coolant flow between the first inlet flow path 11*a* and the second inlet flow path 11*b* may be blocked.

Accordingly, the outlet valve unit 15 may be mounted in the internal flow path of the outlet tank 12 to air-tightly separate the internal flow path. The outlet valve unit 15 may be mounted at a branch point of the internal flow path to divide the internal flow path if necessary. The internal flow path may be classified into a first outlet flow path 12*a* and the second outlet flow path 12*b* with respect to the outlet valve unit 15. The first outlet flow path 12*a* is a portion where the outlet nipple 121 is mounted in the internal flow path that has been divided with respect to the outlet valve unit 15, and may be directly communicating with the outlet nipple 121. The second outlet flow path 12*b* is a portion where the outlet nipple 121 is not mounted in the internal flow path that has been divided with respect to the outlet valve unit 15, and cannot be directly communicating with the outlet nipple 121. The second outlet flow path 12*b* may be indirectly communicating with the outlet nipple 121 through the second inlet flow path 11*b*. When the first outlet flow path 12*a* and the second outlet flow path 12*b* are separated by the outlet valve unit 15 mounted therebetween, the direct coolant flow between the first outlet flow path 12*a* and the second outlet flow path 12*b* may be blocked.

To install the inlet valve unit 14 and the outlet valve unit 15 in the inlet tank 11 and the outlet tank 12, as shown in FIG. 1, FIG. 2, and FIG. 3, the inlet tank 11 and the outlet tank 12 may be provided with the inlet membrane 112 and an outlet membrane 122, respectively.

The inlet membrane 112 may be attached to the inside surface of the inlet tank 11 or integrally formed on the inside surface of the inlet tank 11 to be mounted in the internal flow path of the inlet tank 11. The inlet membrane 112 can have the outside surface air-tightly bonded to the inside surface of the inlet tank 11. The inlet membrane 112 may be mounted between the first inlet flow path 11*a* and the second inlet flow path 11*b*. The inlet membrane 112 can have the inlet flow hole 112*a* provided at the center portion thereof. The inlet flow hole 112*a* may be open or closed by the inlet valve unit 14.

The outlet membrane 122 may be attached to the inside surface of the outlet tank 12 or integrally formed on the inside surface of the outlet tank 12 to be mounted in the internal flow path of the outlet tank 12. When the outlet membrane 122 is attached to the inside surface of the outlet tank 12, the outside surface of the outlet membrane 122 may be air-tightly bonded to the inside surface of the outlet tank 12. The outlet membrane 122 may be mounted between the first outlet flow path 12*a* and the second outlet flow path 12*b*. The outlet membrane 122 can have an outlet flow hole 122*a* formed at the center portion thereof. The outlet flow hole 122*a* may be open or closed by the outlet valve unit 15.

Accordingly, some passage (i.e., first passage) P1 among the coolant passages connected adjacent to the second outlet flow path 12*b* are connected adjacent to the first inlet flow path 11*a*, and the coolant passage (i.e., second passage) P2 not adjacent to the first inlet flow path 11*a* among the coolant passages connected to the second outlet flow path 12*b* is connected adjacent to the second inlet flow path 11*b*. Accordingly, the coolant passage (i.e., third passage) P3 not adjacent to the second outlet flow path 12*b* among the coolant passages connected adjacent to the second inlet flow path 11*b* is connected adjacent to the first outlet flow path 12*a*.

Therefore, the coolant flowing into the inlet tank 11 through the inlet nipple 111 may be prevented from flowing into the second inlet flow path 11*b* through the inlet flow hole 112*a* when the inlet flow hole 112*a* is closed by the inlet valve unit 14. Furthermore, the coolant flowing into the second outlet flow path 12*b* through the coolant passage 131 of the radiator core 13 may be prevented from flowing into the first outlet flow path 12*a* through the outlet flow hole 122*a* when the outlet flow hole 122*a* is closed by the outlet valve unit 15.

The inlet nipple 111 may be mounted on the upper end portion of the inlet tank 11, and the outlet nipple 121 may be mounted on the lower end portion of the outlet tank 12 with respect to the perpendicular direction of the vehicle.

When the internal flow paths of the inlet tank 11 and the outlet tank 12 are air-tightly separated by the inlet valve unit 14 and the outlet valve unit 15, the heat-dissipation amount of the coolant flowing into the radiator core 13 through the inlet nipple 111 increases as the time heat-dissipated within the radiator core 13 is relatively extended, and at the same time, the flow resistance of the coolant increases and the flow rate of the coolant per unit time reduces. That is, as the internal flow path is divided, the coolant heat-dissipation performance of the radiator 1 increases, but it may be difficult to increase the heat-dissipation performance of the radiator 1 as much as desired, as the flow rate of the coolant reduces.

Therefore, it is preferable to provide an electronic water pump 17 separately froman engine water pump 16 for circulating the coolant to increase the flow rate of the coolant flowing through the radiator 1 if necessary. The engine water pump 16 and the electronic water pump 17 may be mounted between the radiator 1 and the engine 19 to circulate the coolant to the engine 19 and the radiator 1. The engine water pump 16 and the electronic water pump 17 may be driven according to the temperature of the coolant.

For example, the engine water pump 16 may be mounted between a coolant inlet 191 of the engine 19 and the outlet nipple 121 of the radiator 1 to circulate the coolant fed from the radiator 1 to the engine 19 at a certain pressure. The electronic water pump 17 may be mounted between a coolant outlet 192 of the engine 19 and the inlet nipple 111 of the radiator 1 to increase the flow rate of the coolant circulated in the radiator 1 by the engine water pump 16.

The electronic water pump 17 may be controlled to be driven by a controller 18 according to the temperature of the coolant. The controller 18 may be a controller for controlling the operations of the inlet valve unit 14 and the outlet valve unit 15. The engine water pump 16 may be operated at all times when the heat-dissipation of the coolant is required by the driving of the engine 19, etc., and the electronic water pump 17 may be selectively operated according to the temperature of the coolant. The controller 18 may be an engine controller provided in the vehicle.

The controller 18 can control the operations of the valve units 14, 15 and the electronic water pump 17 step by step according to the heat-dissipation amount of the coolant passing through the radiator 1. The heat-dissipation amount of the coolant is A<B<C<D.

A: the case where the engine water pump 16 is driven and the internal flow paths of the inlet tank 11 and the outlet tank 12 are not separated by the valve units 14, 15

B: the case where the engine water pump 16 is driven and the internal flow paths of the inlet tank 11 and the outlet tank 12 are separated by the valve units 14, 15

C: the case where the engine water pump 16 and the electronic water pump 17 are simultaneously driven and the internal flow paths of the inlet tank 11 and the outlet tank 12 are not separated by the valve units 14, 15

D: the case where the engine water pump 16 and the electronic water pump 17 are simultaneously driven and the internal flow paths of the inlet tank 11 and the outlet tank 12 are separated by the valve units 14, 15

When the internal flow paths of the inlet tank 11 and the outlet tank 12 are divided by the valve units 14, 15 (B), the heat-dissipation amount of the coolant increases as compared with before the internal flow paths of the tanks 11, 12 are divided (A) but the flow resistance of the coolant increases, such that the heat-dissipation amount of the coolant is smaller than when the flow rate of the coolant increases as the engine water pump 16 and the electronic water pump 17 are simultaneously driven (C).

The controller 18 can divide the temperature of the coolant into four zones to control the operations of the valve units 14, 15 and the electronic water pump 17. The temperature of the coolant may be classified into the zone which is lower than a first reference temperature T1, the zone which is the first reference temperature T1 or higher and lower than a second reference temperature T2, the zone which is the second reference temperature T2 or higher and lower than a third reference temperature T3, and the zone which is the third reference temperature T3 or higher. The third reference temperature T3 may be set to a value higher than the second reference temperature T2 by a certain value or higher, and the second reference temperature T2 may be set to a value higher than the first reference temperature T1 by a certain value or higher.

Figure 4:
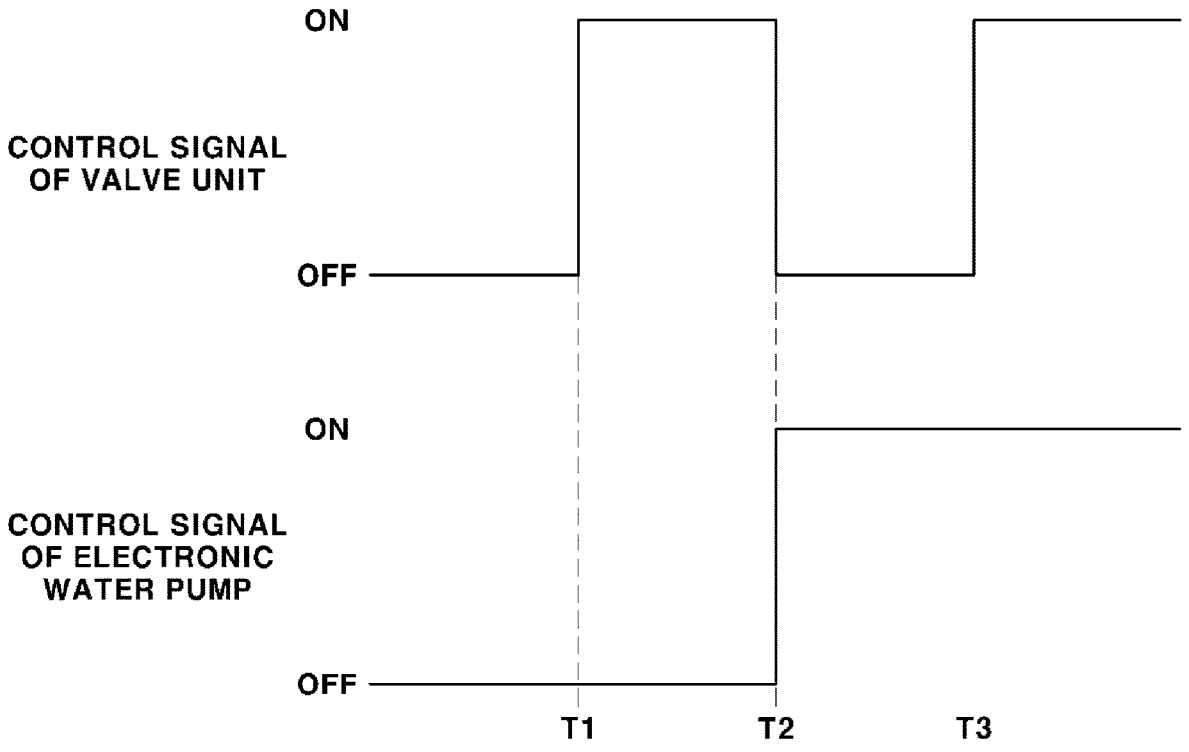
FIG. 4 is a graph showing an ON/OFF control method of the valve unit and an electronic water pump according to the temperature of the coolant.

The controller 18 operates only the engine water pump 16 when the temperature of the coolant is lower than the first reference temperature T1, and does not operate the electronic water pump 17, the inlet valve unit 14, and the outlet valve unit 15 (see FIG. 4). The controller 18 can operate only the engine water pump 16 until the temperature of the coolant reaches the first reference temperature T1.

Accordingly, when the temperature of the coolant is the first reference temperature T1 or higher, the controller 18 operates the inlet valve unit 14 so that the internal flow path of the inlet tank 11 includes the first inlet flow path 11*a* and the second inlet flow path 11*b*, and operates the outlet valve unit 15 so that the internal flow path of the output tank 12 is separated into the first outlet flow path 12*a* and the second outlet flow path 12*b* (see FIG. 4). The controller 18 can operate the inlet valve unit 14, the outlet valve unit 15, and the engine water pump 16 until the temperature of the coolant reaches the second reference temperature T2. At the instant time, the controller 18 does not operate the electronic water pump 17.

Furthermore, the controller 18 can simultaneously drive the engine water pump 16 and the electronic water pump 17, when the temperature of the coolant is the second reference temperature T2 or higher (see FIG. 4). The controller 18 can drive the engine water pump 16 and the electronic water pump 17 until the temperature of the coolant reaches the third reference temperature T3. At the instant time, the controller 18 does not operate the inlet valve unit 14 and the outlet valve unit 15. That is, the inlet valve unit 14 and the outlet valve unit 15 may be operated when the temperature of the coolant is the first reference temperature T1 or higher and lower than the second reference temperature T2.

Furthermore, when the temperature of the coolant is the third reference temperature T3 or higher, the controller 18 can operate the inlet valve unit 14 and the outlet valve unit 15 while driving the engine water pump 16 and the electronic water pump 17 (see FIG. 4). When the temperature of the coolant increases and becomes the third reference temperature T3 or higher, the controller 18 operates both the water pumps 16, 17 and the valve units 14, 15 to maximally increase the heat-dissipation performance of the radiator 1, securing the cooling performance of the coolant.

Figure 5:
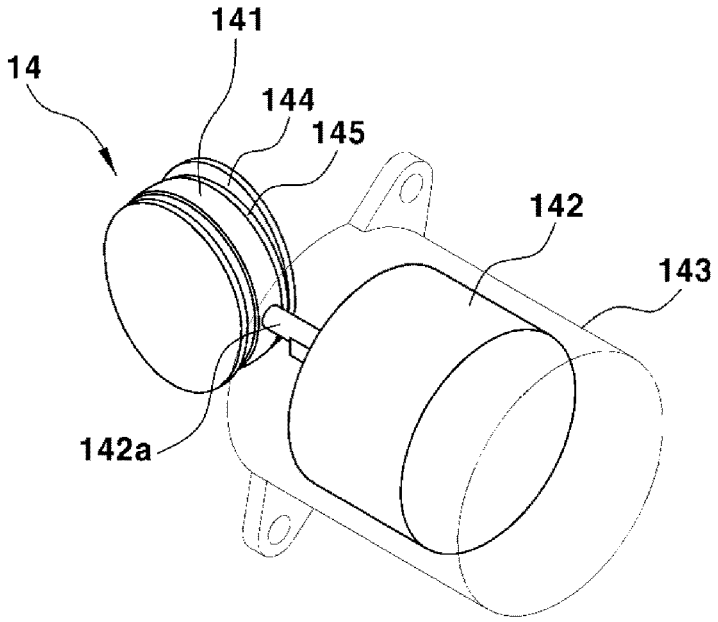
FIG. 5 and FIG. 6 are diagrams showing an inlet valve unit.
Figure 6:
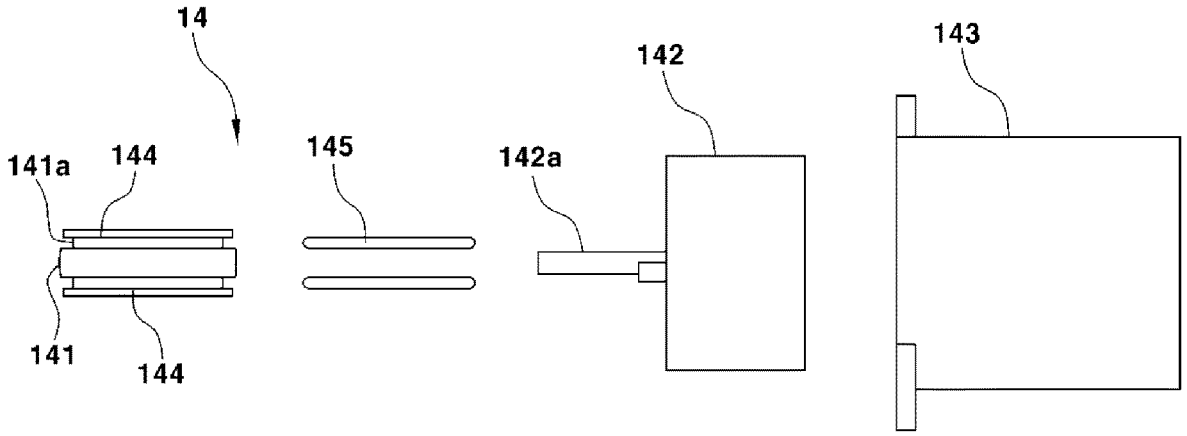
Figure 7:
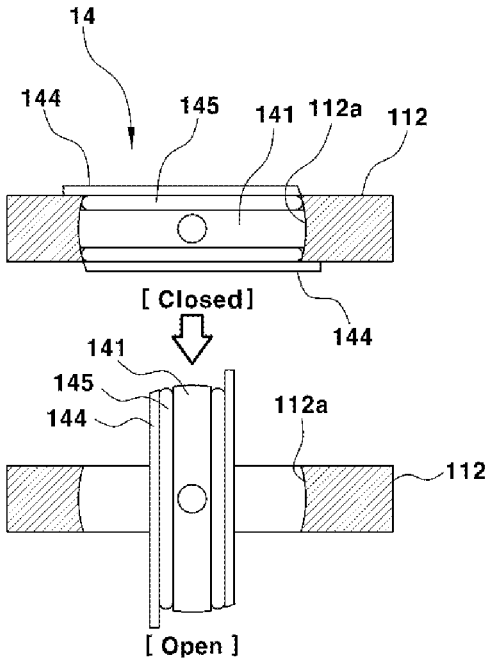
FIG. 7 is a diagram showing an operating state of the inlet valve unit.

Meanwhile, as shown in FIG. 5, FIG. 6 and FIG. 7, the inlet valve unit 14 may be configured to include an inlet valve 141, an inlet motor 142, an inlet stopper 144, an inlet O-ring 145, etc.

The inlet valve 141 can have a structure configured for opening and closing the inlet flow hole 112*a* of the inlet membrane 112 to be rotatably mounted in the inlet flow hole 112*a*. That is, the inlet valve 141 may be configured to be rotated in the inlet flow hole 112*a* to open or close the inlet flow hole 112*a*. The inlet valve 141 may be applied with a throttle valve.

The inlet motor 142 may be configured to rotate the inlet valve 141 by a predetermined certain angle. The inlet motor 142 may be mounted and fixed to the outside of the inlet tank 11 by a motor housing 143. A shaft 142*a* of the inlet motor 142 may be connected to the inlet valve 141 through one side of the inlet membrane 112 from the outside thereof surface of the inlet tank 11. The operation of the inlet motor 142 may be controlled by the controller 18. That is, the driving of the inlet motor 142 may be controlled by the controller 18 so that the rotation angle of the inlet valve 141 may be controlled. For example, the inlet motor 142 can rotate the inlet valve 141 by 90° in the forward direction to open the inlet flow hole 112*a*, and rotate the inlet valve 141 by 90° in the reverse direction to close the inlet flow hole 112*a* again. The inlet motor 142 may be applied with a servo motor.

The inlet stopper 144 may be configured to limit the rotation angle of the inlet valve 141 when the inlet valve 141 is rotated in the direction of closing the inlet flow hole 112*a*. The inlet stopper 144 can limit the rotation angle of the inlet valve 141 to accurately stop the inlet valve 141 at a position where the inlet flow hole 112*a* is closed. The inlet stopper 144 may be provided on the inlet valve 141 to be rotatable integrally with the inlet valve 141, and when the inlet valve 141 is rotated in the direction of closing the inlet flow hole 112*a*, the rotation of the inlet valve 141 may be stopped while being locked by the surface of the inlet membrane 112. The inlet stopper 144 may be mounted at one side of the inlet valve 141 to be protruded further outwards than the external circumferential surface of the inlet valve 141, and when the inlet valve 141 completely closes the inlet flow hole 112*a*, the inlet stopper 144 may be accommodated by contacting with the surface of the inlet membrane 112.

A gap may be present between the inlet flow hole 112*a* and the inlet valve 141 for smoothly rotating the inlet valve 141. Therefore, the inlet O-ring 145, which can seal the inlet flow hole 112*a* when the inlet valve 141 closes the inlet flow hole 112*a*, may be mounted on an external circumferential surface of the inlet valve 141.

The inlet O-ring 145 can remove the gap between the inlet flow hole 112*a* and the inlet valve 141 when the inlet flow hole 112*a* is closed by the inlet valve 141 to seal the inlet flow hole 112*a*. That is, the inlet O-ring 145 may be in close contact with the internal circumferential surface of the inlet membrane 112 surrounding the inlet flow hole 112*a* when the inlet valve 141 closes the inlet flow hole 112*a*, preventing the coolant from flowing between the internal circumferential surface of the inlet membrane 112 and the inlet valve 141.

The external circumferential surface of the inlet valve 141 can have a step structure for mounting the inlet O-ring 145. That is, a step 141*a* for assembling the inlet O-ring 145 may be provided on an external circumferential surface of the inlet valve 141. The step 141*a* may be mounted on the end portion of the inlet valve 141. The inlet O-ring 145 mounted on the step 141*a* may be supported by the inlet stopper 144 to be prevented from being detached from the inlet valve 141. The inlet stopper 144 may be formed in a plate type to support the inlet O-ring 145 mounted to the step 141*a*.

Figure 8:
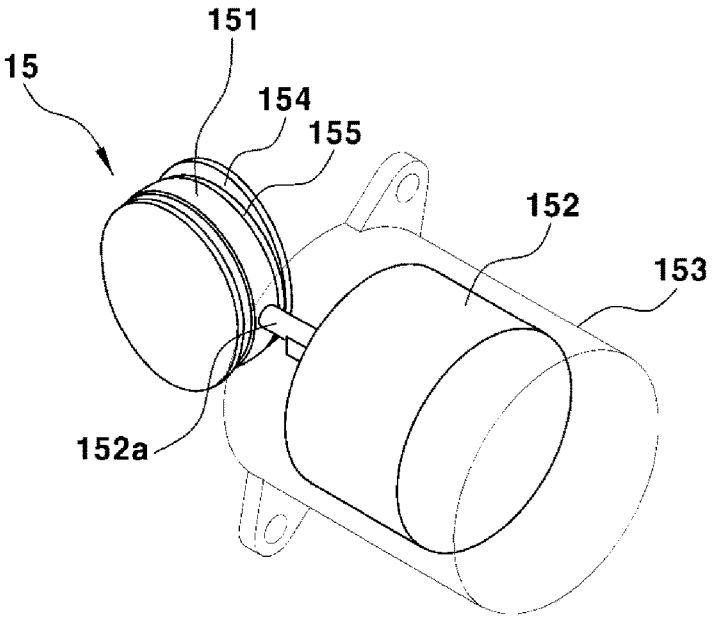
FIG. 8 and FIG. 9 are diagrams showing an outlet valve unit.
Figure 9:
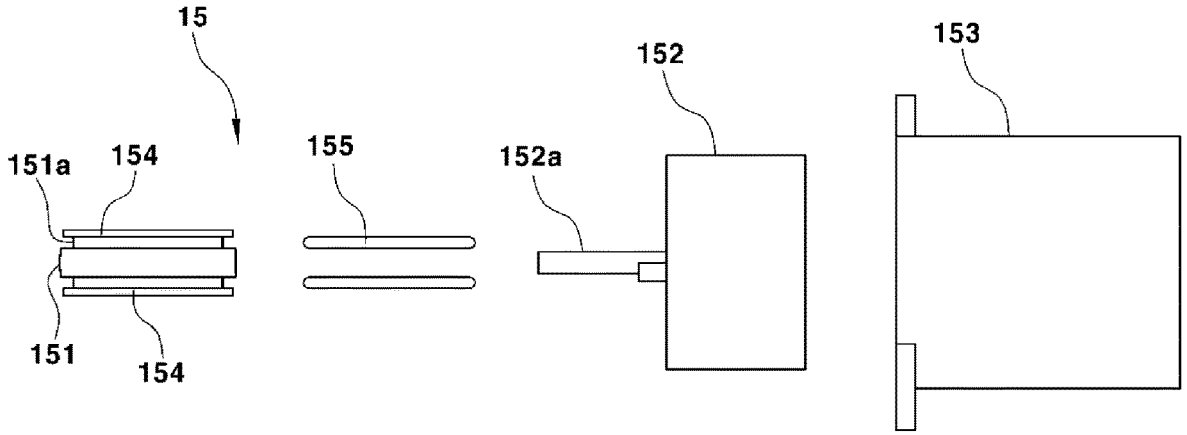
Figure 10:
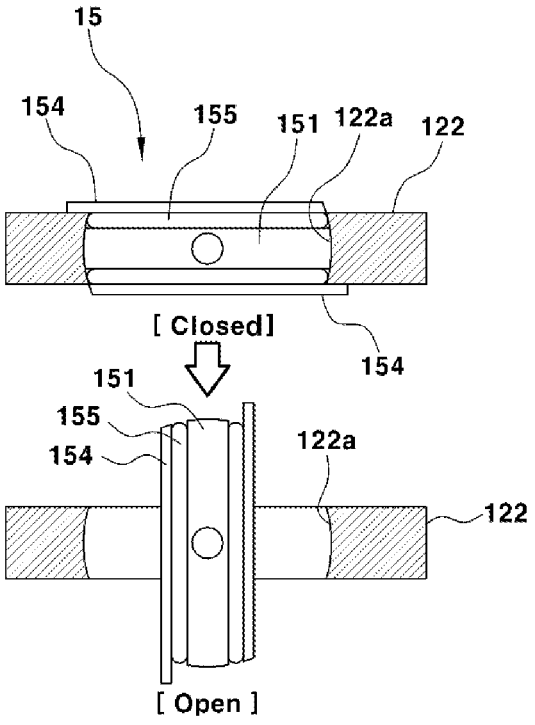
FIG. 10 is a diagram showing an operating state of the outlet valve unit.
Figure 11:
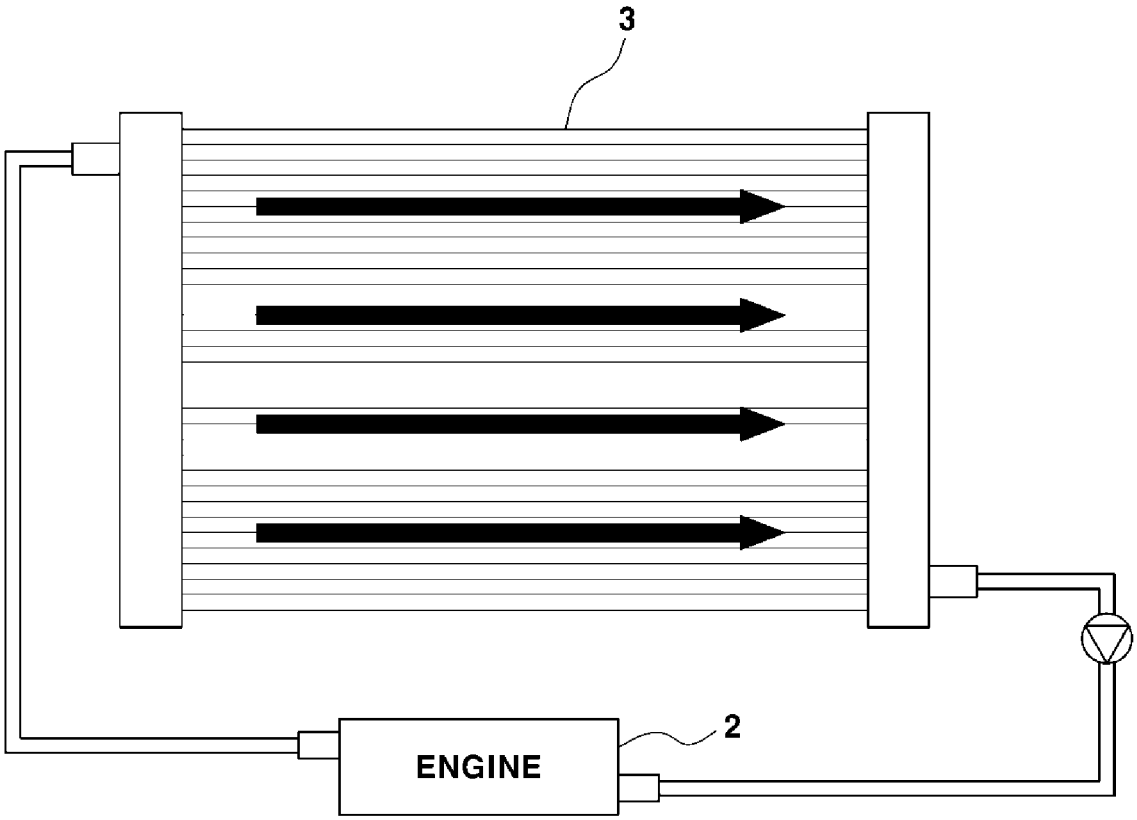
FIG. 11 is a diagram showing the coolant flow path of a conventional radiator.

As shown in FIG. 8, FIG. 9 and FIG. 10, the outlet valve unit 15 may be configured to include an outlet valve 151, an outlet motor 152, an outlet stopper 154, and an outlet O-ring 155.

The outlet valve 151 can have a structure configured for opening and closing the outlet flow hole 122*a* of the outlet membrane 122 to be rotatably mounted in the outlet flow hole 122*a*. That is, the outlet valve 151 may be configured to be rotated in the outlet flow hole 122*a* to open or close the outlet flow hole 122*a*. The outlet valve 151 may be applied with a throttle valve.

The outlet motor 152 may be configured to rotate the outlet valve 151 by a predetermined certain angle. The outlet motor 152 may be mounted and fixed to the outside of the outlet tank 12 by a motor housing 153. A shaft 152*a* of the outlet motor 152 may be integrally connected to the outlet valve 151 through one side of the outlet membrane 122 from the outside thereof surface of the outlet tank 12. The operation of the outlet motor 152 may be controlled by the controller 18. That is, the driving of the outlet motor 152 may be controlled by the controller 18 so that the rotation angle of the outlet valve 151 may be controlled. For example, the outlet motor 152 can rotate the outlet valve 151 by 90° in the forward direction to open the outlet flow hole 122*a*, and rotate the outlet valve 151 by 90° in the reverse direction to close the outlet flow hole 122*a* again. The outlet motor 152 may be applied with a servo motor.

The outlet stopper 154 may be configured to limit the rotation angle of the outlet valve 151 when the outlet valve 151 is rotated in the direction of closing the outlet flow hole 122*a*. The outlet stopper 154 limits the rotation angle of the outlet valve 151 so that the outlet valve 151 may be accurately stopped at a position where the outlet flow hole 122*a* is closed. The outlet stopper 154 may be provided on the outlet valve 151 to be rotatable integrally with the outlet valve 151, and when the outlet valve 151 is rotated in the direction of closing the outlet flow hole 122*a*, the outlet valve 151 may be stopped at a position where the outlet flow hole 122*a* is closed while being locked by the surface of the outlet membrane 122. The outlet stopper 154 may be mounted at one side of the outlet valve 151 to be protruded further outwards than the external circumferential surface of the outlet valve 151, and when the outlet valve 151 completely closes the outlet flow hole 122*a*, the outlet stopper 154 may be accommodated by contacting with the surface of the outlet membrane 122.

A gap may be present between the outlet flow hole 122*a* and the outlet valve 151 for smoothly rotating the outlet valve 151. Therefore, the outlet O-ring 155 for sealing the outlet flow hole 122*a* may be mounted on an external circumferential surface of the outlet valve 151 when the outlet valve 151 closes the outlet flow hole 122*a*.

The outlet O-ring 155 can remove the gap between the outlet flow hole 122*a* and the outlet valve 151 when the outlet flow hole 122*a* is closed by the outlet valve 151 to close the outlet flow hole 122*a*. That is, the outlet O-ring 155 may be in close contact with the internal circumferential surface of the outlet membrane 122 surrounding the outlet flow hole 122*a* when the outlet valve 151 closes the outlet flow hole 122*a*, preventing the coolant from flowing between the internal circumferential surface of the outlet membrane 122 and the outlet valve 151.

The external circumferential surface of the outlet valve 151 can have a step structure for mounting the outlet O-ring 155. That is, a step 151*a* for assembling the outlet O-ring 155 may be provided on an external circumferential surface of the outlet valve 151. The step 151*a* may be mounted on the end portion of the outlet valve 151. The outlet O-ring 155 mounted on the step 151*a* may be supported by the outlet stopper 154, being prevented from being detached from the outlet valve 151. The outlet stopper 154 may be formed in a plate shape to support the outlet O-ring 155 mounted to the step 151*a*.

The engine coolant cooling system for the vehicle configured as described above has the following advantages.

It is possible to change the flow path of the coolant flowing into the radiator 1 without increasing the size of the radiator 1, increasing the amount of heat-dissipation amount of the coolant, and furthermore, to increase the flow rate of the coolant using the electronic water pump 17, further increasing the heat-dissipation amount of the coolant.

It is possible to control the heat-dissipation amount of the coolant passing through the radiator 1 according to the temperature of the coolant, and therefore, to heat-dissipate the coolant if necessary, securing the cooling performance of the coolant.

It is possible to prevent the problem that the layout of the engine compartment becomes more complicated due to the increase of the size of the radiator.

It is possible to secure the gap between the radiator 1 and the engine 19 by keeping the size of the radiator 1, securing the collision performance of the vehicle.

It is possible to increase the maximum heat-dissipation amount of the radiator 1 by the operations of the valve units 14, 15 and the electronic water pump 17 so that the engine exhaust heat may be further cooled, advantageously securing the optimum catalyst temperature for enhancing the purification performance of the catalytic converter.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. An engine coolant cooling system for a vehicle, the engine coolant cooling system comprising:

a radiator including an inlet tank provided with an inlet nipple for inflow of coolant, an outlet tank provided with an outlet nipple for discharging the coolant, and a radiator core including a plurality of coolant passages connected between the inlet tank and the outlet tank to heat-dissipate the coolant;

an inlet valve unit mounted in an internal flow path of the inlet tank to selectively divide the internal flow path of the inlet tank into a first inlet flow path fluidically-communicating with the inlet nipple and a second inlet flow path separated from the inlet nipple;

an outlet valve unit mounted in an internal flow path of the outlet tank to selectively divide the internal flow path of the outlet tank into a first outlet flow path fluidically-communicating with the outlet nipple and a second outlet flow path not fluidically-communicating with the outlet nipple; and a controller configured for controlling operations of the inlet valve unit and the outlet valve unit according to a temperature of the coolant, wherein a predetermined passage among the plurality of coolant passages connected to the second outlet flow path is connected to the first inlet flow path, and a coolant passage not connected to the first inlet flow path among the plurality of coolant passages connected to the second outlet flow path is connected to the second inlet flow path, wherein the controller is configured to selectively operate the inlet valve unit to divide the internal flow path of the inlet tank into the first inlet flow path and the second inlet flow path, and configured to selectively operate the outlet valve unit to divide the internal flow path of the outlet tank into the first outlet flow path and the second outlet flow path, when the temperature of the coolant is equal to or higher than a first reference temperature, wherein the controller is configured to not operate the inlet valve unit and the outlet valve unit, when the temperature of the coolant is lower than the first reference temperature, wherein an engine water pump and an electronic water pump for circulating the coolant are mounted between the radiator and an engine, and the electronic water pump is driven according to the temperature of the coolant to increase a flow rate of the coolant circulated in the engine and the radiator by the engine water pump, and wherein the controller is configured to operate the engine water pump and does not operate the electronic water pump, when the temperature of the coolant is lower than the first reference temperature.

2. The engine coolant cooling system for the vehicle of claim 1, wherein the coolant passage not connected to the second outlet flow path among the plurality of coolant passages connected to the second inlet flow path is connected to the first outlet flow path.

3. The engine coolant cooling system for the vehicle of claim 1, wherein the plurality of coolant passages is mounted and connected in a line between the inlet tank and the outlet tank.

4. The engine coolant cooling system for the vehicle of claim 1, wherein the controller is configured to drive the engine water pump and the electronic water pump, when the temperature of the coolant becomes equal to or higher than a second reference temperature, which has been set higher than the first reference temperature.

5. The engine coolant cooling system for the vehicle of claim 4, wherein the controller is configured to not operate the inlet valve unit and the outlet valve unit when the temperature of the coolant is equal to or higher than the second reference temperature.

6. The engine coolant cooling system for the vehicle of claim 4, wherein the controller is configured to operate the inlet valve unit and the outlet valve unit while driving the engine water pump and the electronic water pump, when the temperature of the coolant is equal to or higher than a third reference temperature, which has been set higher than the second reference temperature.

7. The engine coolant cooling system for the vehicle of claim 1, wherein an inlet membrane provided with an inlet flow hole is mounted between the first inlet flow path and the second inlet flow path, and the inlet flow hole is open or closed by the inlet valve unit.

8. The engine coolant cooling system for the vehicle of claim 1, wherein an outlet membrane provided with an outlet flow hole is mounted between the first outlet flow path and the second outlet flow path, and the outlet flow hole is open or closed by the outlet valve unit.

9. The engine coolant cooling system for the vehicle of claim 7, wherein the inlet valve unit includes:

an inlet valve rotatable in the inlet flow hole to open or close the inlet flow hole; and an inlet motor coupled to the inlet valve and controlled by the controller to rotate the inlet valve at a predetermined angle at which the inlet flow hole is open or closed.

10. The engine coolant cooling system for the vehicle of claim 9, wherein an inlet O-ring is mounted on an external circumferential surface of the inlet valve, and the inlet O-ring seals the inlet flow hole when the inlet flow hole is closed by the inlet valve.

11. The engine coolant cooling system for the vehicle of claim 9, wherein the inlet valve is provided with an inlet stopper rotated integrally with the inlet valve, and the inlet stopper stops rotation of the inlet valve while being locked by a surface of the inlet membrane when the inlet valve closes the inlet flow hole.

12. The engine coolant cooling system for the vehicle of claim 8, wherein the outlet valve unit includes:

an outlet valve rotatable in the outlet flow hole to open or close the outlet flow hole; and an outlet motor coupled to the outlet valve and controlled by the controller to rotate the outlet valve at a predetermined angle at which the outlet flow hole is open or closed.

13. The engine coolant cooling system for the vehicle of claim 12, wherein an outlet O-ring is mounted on an external circumferential surface of the outlet valve, and the outlet O-ring seals the outlet flow hole when the outlet flow hole is closed by the outlet valve.

14. The engine coolant cooling system for the vehicle of claim 12, wherein the outlet valve is provided with an outlet stopper rotated integrally with the outlet valve, and the outlet stopper stops rotation of the outlet valve while being locked by a surface of the outlet membrane when the outlet valve closes the outlet flow hole.

* * * * *